United States Patent [19]

Martin

[11] Patent Number: 4,643,513

[45] Date of Patent: Feb. 17, 1987

[54] UNIVERSAL ELECTRICAL CONNECTOR

[76] Inventor: Charles B. Martin, 309 Old Farm Rd., Louisville, Ky. 40207

[21] Appl. No.: 807,966

[22] Filed: Dec. 12, 1985

[51] Int. Cl.[4] ..... H01R 11/22; H01R 4/30; H01R 4/38

[52] U.S. Cl. ..... 339/254 R; 339/255 R; 339/263 R

[58] Field of Search ..... 339/95 D, 254 R, 254 M, 339/255 R, 255 B, 263 R, 268 R; 411/338, 339, 411/383, 384

[56] References Cited

U.S. PATENT DOCUMENTS

| | | | |
|---|---|---|---|
| 804,232 | 11/1905 | Jackson | 339/255 B |
| 2,272,552 | 2/1942 | Field | 339/263 R |
| 2,447,254 | 8/1948 | Jorgensen | 339/255 R |
| 2,457,593 | 12/1948 | Nelson | 339/254 R |
| 2,691,144 | 10/1954 | Parsons et al. | 339/255 R |
| 2,960,677 | 11/1960 | Stearn et al. | 339/254 R |
| 3,104,926 | 9/1963 | Scoville | 339/254 M |

FOREIGN PATENT DOCUMENTS

| | | | |
|---|---|---|---|
| 561141 | 7/1958 | Canada | 339/255 R |

*Primary Examiner*—E. Michael Combs
*Attorney, Agent, or Firm*—Richard L. Caslin

[57] ABSTRACT

Several modifications of electrical connectors are shown for the quick connection of the bare ends of lead wires including all types of terminals such as flat ring terminals, or flag or right angle push-on terminals. One modification of this connector has a central elongated screw with a lower end that is adapted to be clamped into the hole of an insulating panel by a pair of adjustable nuts. The screw extends vertically from the panel, and it supports an elongated coupling nut that is threaded onto the screw. An inverted conical spring surrounds the coupling nut, where the lower end is the smallest end, and it is seated upon a flat washer. The upper end of the conical spring is the larger end, and it supports a large washer that slips down over the upper end of the coupling nut. A cup washer is seated upon the top of the coupling nut, and the top end of the screw is formed with a screw head that locks the cup washer to the coupling nut. When an electrical connection is to be made, a force is applied at one side edge of the large washer so as to compress the conical spring and pivot the large washer from its opposite side relative to the cup washer so as to capture a lead wire end, or terminal, in the gap formed between the deflected large washer and the cup washer. Another modification is to combine into one element the central screw and the coupling nut and the lower flat washer or hex nut supporting the lower end of the spring. The inverted conical spring may be replaced by a cylindrical spring.

11 Claims, 8 Drawing Figures

UNIVERSAL ELECTRICAL CONNECTOR

BACKGROUND OF THE INVENTION

1. Field of the Invention:

This invention relates to the art of electrical connectors, or electrical terminals, and especially quick-connect terminals, or solderless terminals, for interlocking electrical components in circuit configurations.

2. Description of the Prior Art:

The Jambor U.S. Pat. No. 3,848,947 describes an electrical circuit board terminal springclip including a cylindrical coil spring for cooperation with a rivet that has a shank with a pair of notches formed in the shank near the rivet head. A straight end of the spring is positioned in a slot, and its free end is bent to engage a notch; thereby locking the spring to the rivet and the rivet to the board.

The Brouneus U.S. Pat. No. 3,885,848 describes an electrical contact member comprising a volute helix, or conically spiraled, length of resilient wire that has its upper part formed as a cylindrical helix for receiving the electrically conductive terminal member in the top end thereof. The lower portion of this conical spiral is compressed, or flattened, into a single plane.

The Mocnik U.S. Pat. No. 2,456,302 is not related to an electrical connector, but it describes a conical spring which is fastened at one end to a supporting surface by a wood screw. The purpose of this conical spring is to serve as a supporting device, or clip, for a sheet of paper. A suitable handle is shown at the free end of the spring, and it serves to assist in spreading the coils of the spring apart so as to make room for the paper which is to be captured therein.

The Pumphrey U.S. Pat. No. 1,642,695 describes a binding post to ensure good electrical contact between the binding post and one or more wires that are engaged by it. This patent describes several modifications of binding posts. The preferred embodiment shows a cone-shaped helical spring which terminates at its larger end in a wire-engaging loop member that extends up through the center of the spring and is arranged to cooperate with the top smaller end of the spring as a wire clamp.

The Scoville U.S. Pat. No. 3,104,926 describes a solderless terminal having a cylindrical helical spring that is mounted over a first and a second elongated, U-shaped, conductive terminal members forming a post.

The Stump U.S. Pat. No. 3,566,192 describes an electrical assembly wherein components are connected by resilient coils of electrically conductive, exposed, wire turns. Various components can be coaxially stacked on such coils and interconnected by other components by way of leads inserted between the wire turns.

The Witte et al U.S. Pat. No. 3,170,753 describes an electrical connector having a lead wire-receiving member that cooperates with a sleeve, or collar, that in turn is held in position by the conical, coiled, spring member that is supported on the base plate and held in place by a machine screw. The lead wire is held in place when it is inserted into one of the three peripheral slots. Thus, the lead wire would be held in one of said slots by the internal hoop stress of the conical spring.

The last patent is to Johnston U.S. Pat. No. 3,243,755, which describes an electrical connector having a pair of telescopic conical springs for each electrical connector.

One conical spring is screwed into the other until they assume an interlocking relationship.

OBJECTS OF THE PRESENT INVENTION

The principal object of the present invention is to provide an electrical connector with the capability of making a one-handed quick connection to as many as three lead wire ends, or terminals.

A further object of the present invention is to provide an electrical connector of the class described with the capability of accommodating as many as three electrical connections where the addition of a third connection will not loosen the two connections made earlier with other lead wires, or terminals.

A further object of the present invention is to provide a universal electrical connector for accommodating a plurality of different types of lead wires, or terminals, by using either an inverted conical spring or a cylindrical spring that provides a pivoting clamping action so as to magnify the mechanical advantage of the clamping action.

SUMMARY OF THE INVENTION

The present invention provides a universal electrical connector for the quick connection of the ends of lead wires or various terminal configurations. This connector employs a center post means having a lower end that is to be mounted to a supporting structure. The lower end of the post means supports a flange that provides a seat for a helical spring positioned around the post means. A larger washer is fitted down over the upper end of the post means and it is seated upon the upper end of the spring. A cup washer is fixed to the top end of the post means. The larger washer may be pivoted relative to the cup washer for making the clamping connection.

BRIEF DESCRIPTION OF THE DRAWINGS

This invention will be better understood form the following description taken in conjunction with the accompanying drawings, and its scope will be pointed out in the appended Claims.

DESCRIPTION OF THE PREFERRED EMBODIMENTS

Figure 1:
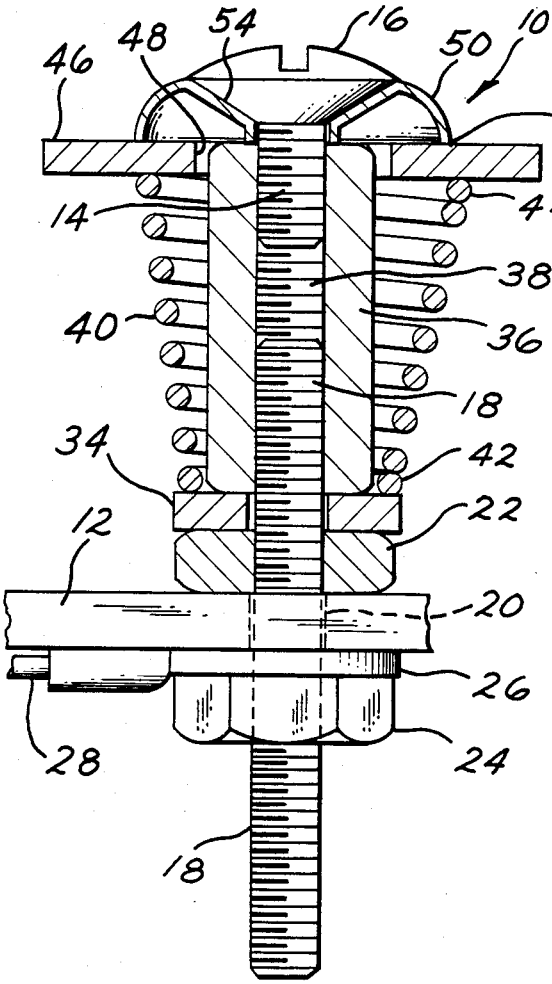
FIG. 1 is a cross-sectional elevational view, on an enlarged scale, of the universal electrical connector of the present invention shown mounted vertically on an insulating panel.
Figure 4:
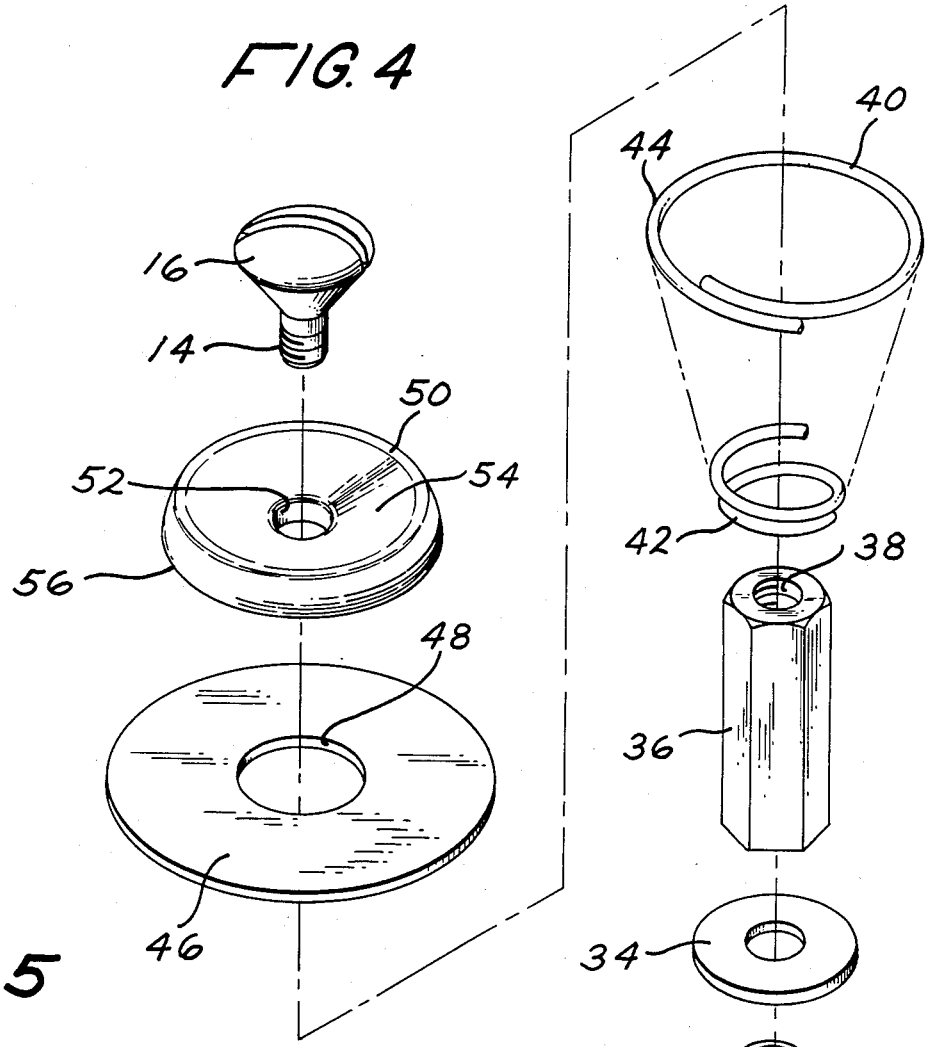
FIG. 4 is an exploded perspective view of the universal electrical connector of the present invention showing all of the parts separated but arranged in the vertical order in which they would be assembled together.

Turning now to a consideration of the drawings and, in particular, to the cross-sectional elevational view of FIG. 1, there is shown the universal electrical connector 10 of the present invention that is designed to be mounted vertically with respect to the thin panel 12. This panel is preferably of insulated material, but if it were not, then suitable insulating means would be interposed between the connector 10 and the panel. In describing the electrical connector 10 of FIG. 1, reference will be made to the exploded perspective view of FIG. 4 where the details of all of the separate parts are clearly illustrated. This connector 10 employs a central screw means that is shown in FIGS. 1 and 4 as two separate screws; namely, a short top screw 14 with a top screw head 16 and an elongated bottom screw 18, which is a headless screw. This bottom screw 18 is adapted to fit through a mating hole 20 in the panel 12, shown in dotted lines in FIG. 1.

The bottom screw 18 is fitted with two adjustable nuts, 22 and 24. The upper nut 22 seats on the top surface of the panel 12, while the lower nut 24 serves as a lock nut to lock the electrical connector assembly 10 to the panel 12. Notice, in FIG. 1, a ring terminal 26 that is fitted on the end of a lead wire 28 was first assembled onto the lower end of the bottom screw 18 and brought up against the underside of the panel 12 when the lower adjustable nut 24 is tightened in place, so that the nut 24 serves to make an electrical connection between the ring terminal 26 and the bottom screw 18 of the electrical connector 10 of the present invention.

These two adjustable nuts, 22 and 24, are shown as hex nuts. The upper nut 22 supports, on its top side, a flat washer 34. Supported on the top side of this flat washer 34 is an elongated coupling nut 36, which is threaded onto the upper end of the bottom screw 18. This coupling nut 36 is sometimes referred to in this art as a stand-off nut. It is many times higher than the height of a standard adjustable nut 22. This coupling nut 36 has internal screw threads 38 which extend completely through the coupling nut. As seen in FIG. 4, this coupling nut 36 is also of hex shape for ease in applying a wrench to turn the coupling nut on the bottom screw 18.

Surrounding the coupling nut 36 is an inverted conical spring 40. The lower end 42 of the conical spring is of much smaller diameter than the diameter of the upper end 44 of the spring. A large flat washer 46 has a large central hole 48 which is capable of fitting over the upper end of the coupling nut 36, as shown in FIG. 1. This large washer 46 is seated upon the upper end 44 of the inverted conical spring 40. A cup washer 50 is seated upon the top end of the coupling nut 36, and it is tightened in place by a short top screw 14 that extends through the central hole 52 of the cup washer and is threaded into the threaded opening in the top end of the coupling nut 36. This action tends to exert a downward force on the large washer 46 against the resistance of the inverted conical spring 40. Notice the nature of the cup washer 50, which is shown in vertical cross section in FIG. 1. It has a recessed top wall 54 for accommodating the mating configuration of the top screw head 16. The underside of the cup washer 50 is generally hollow, thereby providing the down-turned peripheral edge 56 which acts as a hook when certain types of push-on terminals (not shown) are joined to this electrical connector.

Figure 2:
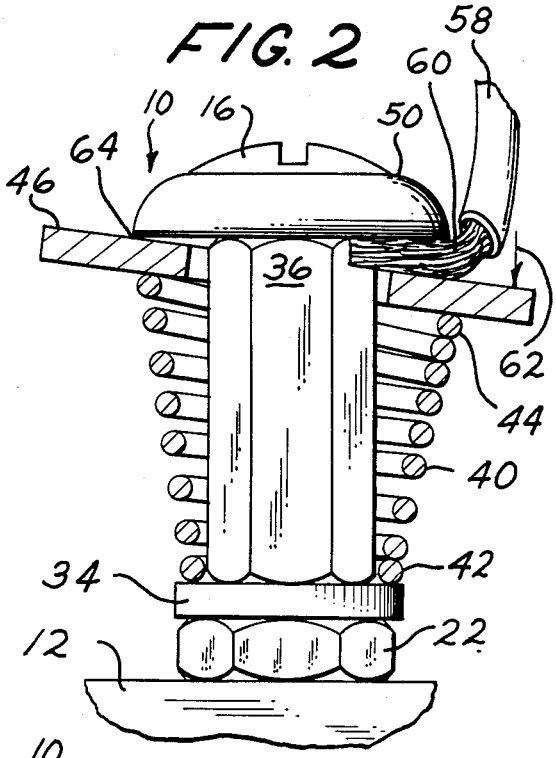
FIG. 2 is a fragmentary elevational view, similar to that of FIG. 1, with only a few of the parts of the connector shown in cross section, where the large washer at the top of the connector has been deflected downward at the right side so that a bare lead wire could be inserted in the gap formed between the large washer and the underside of the cup washer so that the inverted conical spring would capture the lead wire end in place.

Turning now to a consideration of FIG. 2, this view shows the electrical connector 10 in full view, except that the large flat washer 46 is shown in vertical cross section as well as the inverted conical spring 40. A single lead wire 58 is shown with a bare end 60 captured in the gap formed when a downward pressure 62 is exerted against one side of the large washer 46, thereby causing the washer to pivot about the point 64 where the washer touches the underside of the cup washer 50, as clearly seen in FIG. 2. An important advantage of the use of the present invention is that other lead wires having the same or different kinds of terminations may be quick-connected to this connector 10 without loosening the electrical connection made with the first lead wire 58.

Figure 3:
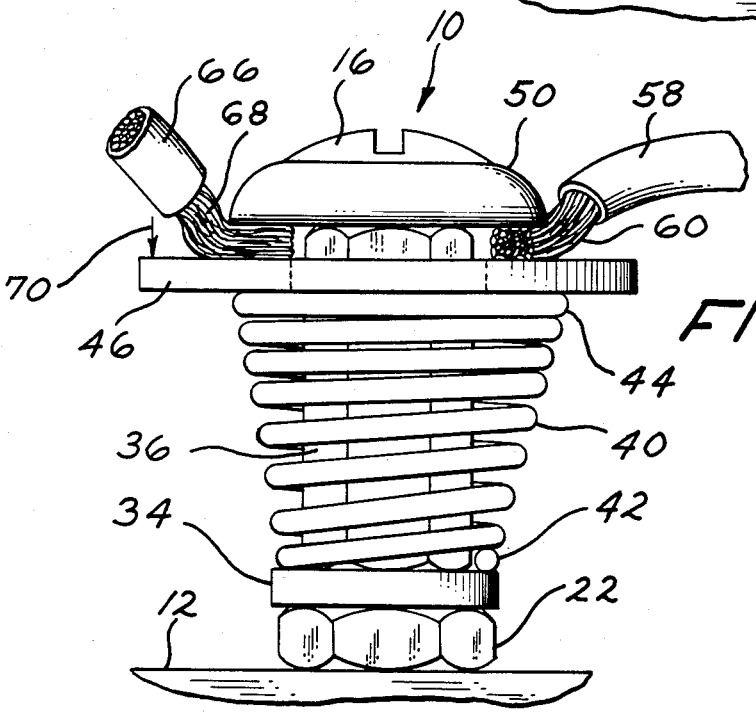
FIG. 3 is a side elevational view of the electrical connector as shown in FIG. 2 but with no parts shown in cross section, where two bare lead wires are captured at opposite sides of the connector in the gap between the large upper washer and the underside of the cup washer.

Attention is now directed to FIG. 3, which is a side elevational view of the connector of FIG. 2, where all parts are shown in full lines. The first lead wire 58 with its bare end 60 is still shown connected in place. A second lead wire 66 having a bare end 68 of stranded configuration is shown joined to this electrical connector 10 generally on the opposite side of the connector. It would not be good practice to connect both lead wires 58 and 66 side-by side because, in so doing, the first connection may be loosened while making the second connection. The preferred procedure would be after the first lead wire 58 is connected in place, as shown in FIG. 2, the second lead wire 66 will be brought to the connector from the opposite side of the connector from lead wire 58, and the downward force 70 would be applied to the edge of the large washer 46 near where the second lead wire 66 was to be connected. This would cause the washer 46 to pivot with respect to the bare end 60 of the first lead wire 58 and to form a suitable gap so that the bare end 68 of the second lead wire 66 could be positioned under the cup washer before the downward force 70 is removed.

The drawings do not show the use of push-on terminals which have an irregular height configuration, but it will be appreciated by those skilled in this art that such push-on terminals would be captured by the down-turned, hook-shaped, peripheral edge 56 of the cup washer 50.

Figure 5:
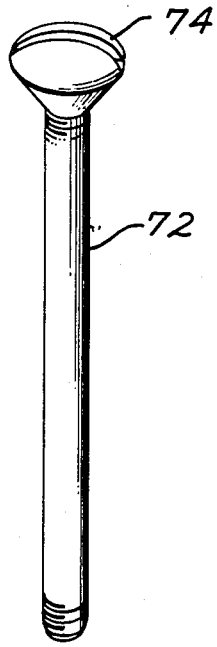
FIG. 5 is a perspective elevational view of a modification of the present invention where the top short screw having the screw head, as well as the lower, elongated, headless screw of FIG. 4 have been incorporated into a single integral screw that is elongated and having a screw head at the top thereof.

Various modifications of the present invention can be made without departing from the scope thereof. One example would be to replace the central screw means represented by the two screws, 14 and 18, of FIGS. 1 and 4 by the single screw modification 72 of FIG. 5. This single screw 72 has a head 74 at its top end that is equivalent to the head 16 of the short top screw 14 of FIG. 4. Also, this single screw 72 has the height equal to the combined height of the short top screw 14 and the elongated bottom screw 18 when they are both threaded into the coupling nut 36, as shown in FIG. 1. This single screw modification has fewer parts and, perhaps, is cheaper than the first modification, but the first modification has an advantage. If the inverted conical spring 40 needed replacement in the first modification, only the short top screw 14 need be removed in order to gain access to the conical spring 40. This can be done without tampering with the mounting means 22 and 24 of the headless bottom screw 18. To perform this same maintenance operation with the single screw modification 72 of FIG. 5, it would be necessary to remove the lower adjustable nut 24 and separate the electrical connector from the panel 12 and then remove the upper nut 22 for taking the spring 36 off from the bottom of the connector.

Figure 6:
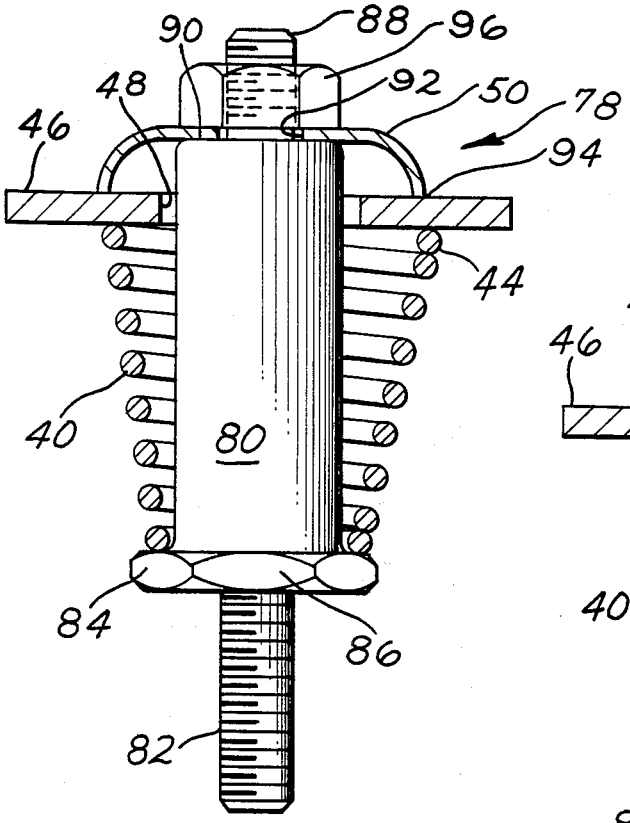
FIG. 6 is a cross-sectional elevational view, on a reduced scale, of another modification of the present invention wherein the central screw means is replaced by a center post means having an integral lower spring seat supporting the helical spring, and where the top cup washer is held to the center post means by means of a fastening nut.

Another modification of the present invention is to combine the flat washer 34 with the upper adjustable nut 22 as one element, as shown in FIG. 6. Moreover, the cup washer 50 could be combined with the head 16 of the short top screw 14 without departing from the scope of the present invention.

Turning to a consideration of FIG. 6, another modification of the electrical connector 78 of the present invention is shown. The main element is a center post 80, which is either a screw machine-fabricated part or a roll formed part having a lower threaded support screw 82 which is formed integral with the enlarged center post 80. This support screw 82 is the equivalent of the elongated bottom screw 18 of the modification of FIG. 1. The integral center post 80 is the equivalent of the elongated coupling nut 36 of FIG. 1. At the top end of the support screw 82 is an integral flange 84 which also serves as a spring seat for the lower end of the inverted conical spring 40. This integral flange 84 is shown with a peripheral configuration 86, similar to that of a hex nut, so that a crescent wrench may be applied to this flange 84 for holding it in place while a lower fastening nut (not shown) would be applied to the lower end of the support screw 82 for fastening this electrical connector in a mounting panel, similar to panel 12 of FIG. 1.

A large, flat washer 46 has a large, central hole 48 which is capable of fitting loosely over the upper end of the center post 80, as shown in FIG. 6. This large washer 46 is seated upon the upper end 44 of the inverted conical spring 40. The upper end of the center post 80 is fitted with a threaded mounting screw 88. A cup washer 50 is seated upon the top ledge 90 of the center post 80. This cup washer has a center hole 92 which slips freely over the threaded mounting screw 88. This cup washer 50 is inverted so that its lower periphery 94 bears against the top side of the large, flat washer 46. Finally, a fastening nut 96 is threaded onto the mounting screw 88 and tightened down until it locks against the cup washer 50. Thus, the inverted cup washer 50 is locked in place relative to the center post 80, while the inverted conical spring 40 is compressed between the lower integral flange 84 and the large, top, flat washer 46.

A main consideration of the preferred embodiment of FIG. 1 is that the various individual elements are available on the market, and they may be obtained without having to undergo special tooling expenses. The modification of FIG. 6 is a less expensive modification, but it would require an initial tooling expense for roll forming or screw machine fabrication of the integral center post 80 with its various elements 82, 84 and 88.

Figure 7:
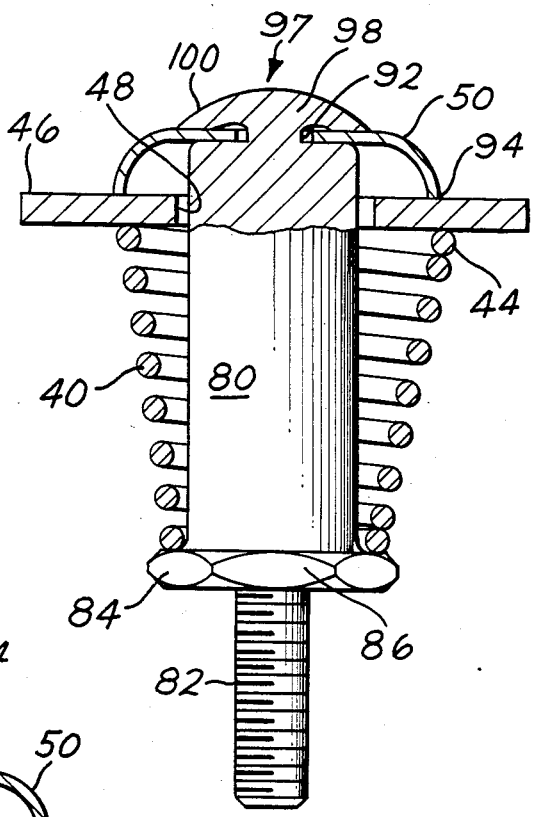
FIG. 7 is an elevational view of another modification of the present invention where the top cup washer is fastened to the top end of the center post means by peening the top end of the post means over the cup washer.

FIG. 7 is another modification of an electrical connector 97, similar to FIG. 6, except that the top, threaded, mounting screw 88 and its cooperating fastening nut 96 have been replaced by a malleable projection 98 which is capable of fitting through the center hole 92 of the inverted cup washer 50. This malleable projection 98 is then hammered, or flattened, to form a head 100 which serves as a permanent fastening means between the top end of the center post 80 and the cup washer 50.

Figure 8:
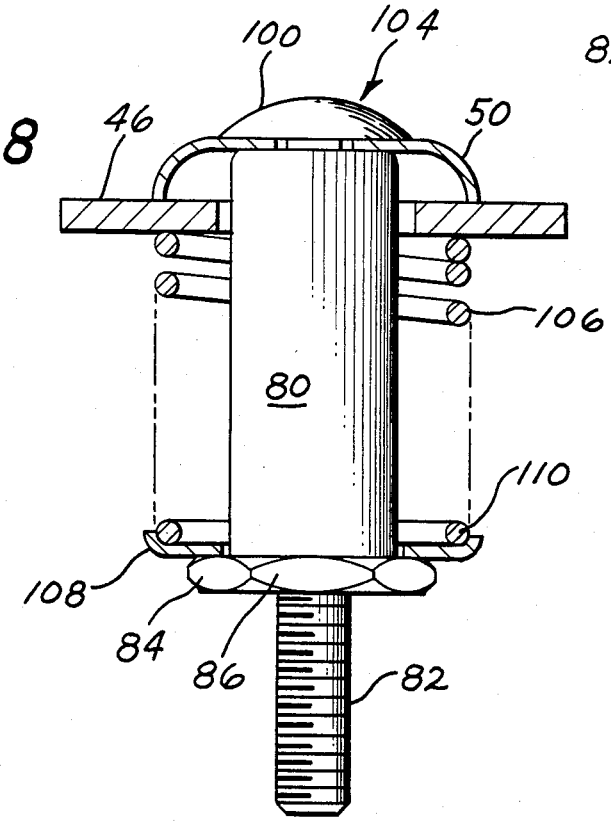
FIG. 8 is an elevational view, similar to that of FIG. 7, of another modification of the present invention where the inverted conical spring has been replaced by a cylindrical helical spring.

FIG. 8 is another modification of electrical connector 104 that is similar to the connector 97 of FIG. 7 except that the inverted conical spring 40 of FIG. 7 has been replaced by a cylindrical helical spring 106. In addition, the lower integral flange 84 has been supplemented by an enlarged spring seat 108 that is capable of accommodating the lower end 110 of the cylindrical spring 106.

Of course, another modification would be to eliminate the lower, threaded, support screw 82, shown in FIGS. 6–8, and boring a hole (not shown) in the lower end of the center post 80 and tapping such a hole for receiving a fastening screw that would be threaded into such a threaded hole.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. An electrical connector for quick connection of ends of lead wires including terminals, said connector comprising:

a. a central screw means having a lower end that is adapted to be attached to a supporting structure and adjustable fastening means cooperating with the lower end for attaching the lower end of the central screw means to the supporting structure;

b. a lower portion of this central screw means having a flange adjacent the said supporting structure, a helical spring encircling the central screw means and seated on the lower flange, a large washer means having an enlarged opening that slips over an upper end of the central screw means, with the washer means seated upon an upper end of the said spring; and c. an inverted cup washer means attached to an upper end of the central screw means and seated upon an upper surface of said washer means, said enlarged opening of said washer means being substantially larger than the dimension of said upper end of said central screw means for permitting both vertical and pivotal mevement of said washer means relative to said inverted cup washer and said upper end of said central screw means;

d. whereby the said large washer means may be depressed at one side edge so as to compress the spring and cause the large washer means to pivot from its opposite side relative to the cup washer means for capturing a lead wire end, or terminal, in the gap formed between the deflected larger washer means and the cup washer means.

2. The invention as recited in claim 1 wherein a threaded fastening means joins the cup washer means to the upper end of the central screw means.

3. The invention as recited in claim 1 wherein the said cup washer means is permanently fixed to the upper end of the central screw means.

4. An electrical connector for quick connection of ends of lead wires including terminals, said connector comprising:

a. a center post means having a lower end that is adapted to be connected to a supporting structure, said lower end also having an integral flange that is adapted to be located adjacent the said supporting structure, said flange having a non-circular periphery that is engageable by a wrench;

b. a helical spring having a lower end supported from the said flange, a large washer means having an enlarged opening that slips over an upper end of the center post means with the washer means seated upon an upper end of the said helical spring; and c. an inverted cup washer means attached to an upper portion of the center post means and seated upon an upper surface of said washer means, said enlarged opening of said washer means being substantially larger than the dimension of said upper end of said center post means for permitting both vertical and pivotal movement of said washer means relative to said inverted cup washer and said upper end of said center post means, whereby the said large washer means may be depressed at one side edge so as to compress the helical spring and cause the large washer means to pivot from its opposite side relative to the cup washer means for capturing a lead wire end, or terminal, in the gap formed between the deflected large washer means and the cup washer means.

5. The invention as recited in claim 4 wherein the said helical spring is a cylindrical helical spring.

6. The invention as recited in claim 4 wherein the said helical spring is an inverted conical spring where the lower end of the spring is of the smallest diameter, and it is supported from the said flange, while the upper end of the conical spring is much larger in diameter than the diameter of the lower end of the spring.

7. An electrical connector for quick connection of ends of lead wires including terminals, said connector comprising:

a. a central screw means having a lower end that is adapted to be supported in a mating hole formed through an insulated panel, said lower end being furnished with an upper and a lower adjustable nut for locking the screw means to the panel;

b. the said upper nut supporting on a top side a flat washer means, an elongated coupling nut threaded onto the said screw means and seated upon the said flat washer means;

c. an inverted conical spring surrounding the coupling nut, where a lower end of the spring is of the smallest diameter and it is seated upon the flat washer means, a large washer means having an enlarged opening that slips over an upper end of the coupling nut with the washer means seated upon an upper end of the spring which is much larger in diameter than the diameter of said lower end of the spring;

d. an inverted cup washer means seated upon an upper end of the coupling nut and an upper surface of said washer means, said enlarged opening of said washer means being substantially larger than the dimension of said upper end of said coupling nut for permitting both vertical and pivotal movement of said washer means relative to said inverted cup washer and said uper end of said coupling nut, and an upper end of the said screw means being formed as a screw head that locks the cup washer means to said upper end of the coupling nut;

e. whereby the said large washer means may be depressed at one side edge so as to compress the spring and cause the large washer means to pivot from its opposite side relative to the cup washer means for capturing a lead wire end, or terminal, in the gap formed between the deflected large washer means and the cup washer means.

8. The invention as recited in claim 7 wherein the said central screw means is a single, elongated, threaded screw having an integral screw head at the top.

9. The invention as recited in claim 7 wherein the said central screw means is divided into a first lower, elongated, headless screw which terminates at the top intermediate the height of the said coupling nut, and a second, upper short screw having the said screw head at its top end, where this short screw is threaded down into the top end of the coupling nut and tightened into place, whereby the conical spring may be replaced by removing the upper short screw without interfering with the two lower adjustable nuts that are adapted to mount this connector to its supporting panel.

10. The invention as recited in claim 7 wherein the said upper adjustable nut supporting the said flat washer means is formed as one integral member.

11. The invention as recited in claim 7 wherein the said cup washer and the adjacent screw head of the central screw means are formed as one integral member.

* * * * *